United States Patent [19]

Wick

[11] 3,960,076

[45] June 1, 1976

[54] ROTARY SCREEN PRINTING MACHINE WITH ANGLE AND PRESSURE ADJUSTABLE SQUEEGEE

[75] Inventor: Karl Wick, Biberist, Switzerland

[73] Assignee: Fritz Buser AG Maschinenfabrik, Wiler near Utzenstorf, Switzerland

[22] Filed: Feb. 25, 1974

[21] Appl. No.: 445,132

[30] Foreign Application Priority Data

Feb. 27, 1973 Switzerland ..... 2826/73

[52] U.S. Cl. ..... 101/119; 101/120

[51] Int. Cl.[2] ..... B41F 15/42

[58] Field of Search ..... 101/116, 118, 119, 120, 101/126, 407 R, 407 A, 407 BP; 269/20, 22; 100/269 A

[56] References Cited

UNITED STATES PATENTS

| | | | |
|---|---|---|---|
| 2,295,979 | 9/1942 | Gorden | 101/123 |
| 3,029,779 | 4/1962 | Hornbostel | 101/119 X |
| 3,410,202 | 11/1968 | Chrubasik | 100/269 A X |
| 3,534,681 | 10/1970 | Beals et al. | 101/407 A X |
| 3,557,690 | 1/1971 | Voegelin | 101/120 |
| 3,587,458 | 6/1971 | Feier | 101/407 R X |
| 3,718,086 | 2/1973 | Vertegaal | 101/120 X |
| 3,735,730 | 5/1973 | Mitter | 101/119 X |
| 3,742,537 | 7/1973 | Merrill | 100/269 A X |

FOREIGN PATENTS OR APPLICATIONS

| | | | |
|---|---|---|---|
| 2,209,630 | 9/1972 | Germany | 101/120 |

*Primary Examiner*—J. Reed Fisher
*Assistant Examiner*—R. E. Suter
*Attorney, Agent, or Firm*—Flynn and Frishauf

[57] ABSTRACT

An adjustable holder secures the squeegee or doctor blade within the rotary stencil of the machine to swing or rock about an axis which is above, and closely adjacent to the contact line of the screen and the printer's blanket or backing cloth, as supported by a support rail, resiliently pressed against the screen to form the contact line at which material to be printed is engaged by the screen.

4 Claims, 5 Drawing Figures

ROTARY SCREEN PRINTING MACHINE WITH ANGLE AND PRESSURE ADJUSTABLE SQUEEGEE

CROSS REFERENCE TO RELATED PATENTS AND APPLICATIONS

U.S. Pat. Nos. 3,557,690; 3,599,565; assigned to the assignee of the present invention.

The present invention relates to a rotary screen printing machine and more particularly to the arrangement which maintains the screen in contact with an underlying printing blanket, and which provides for proper doctoring, for example by means of a doctor blade or a squeegee.

The screens or stencils of rotary screen printing machinery are finely perforated cylindrical screens to which ink is applied, for example in the form of paste, by conducting ink to the interior of the cylindrical screen. The ink is pressed through the interstices of the screen by means of a doctor blade, or a squeegee. Various arrangements to provide for pressing of the ink through the screen are known. Squeegees may, for example, be made of rubber; steel blades or rollers have also been proposed.

The passage of ink through the interstices of the screen of the stencil material depends on various parameters, which include among others the percentage of free space of the interstices with respect to overall area of the screen, the viscosity of the ink, and other mechanical factors, for example screen stiffness and shape, as well as shape of the interstices. The angle of a doctor blade or squeegee, that is, the wedge angle between the interior of the screen and the blade itself is of importance; the length of the wedge, and the application pressure also have a substantial influence on the quality of the printing which is obtained. It is of substantial importance to reproducibly control these factors and parameters. Structures, as heretofore proposed, including various constructions for squeegees and doctor blades, as well as their adjustment systems were not, however, satisfactory for uniform reproducibility.

Known steel blades, used as doctor blades or squeegees were so constructed that the angle of application could be changed. Simultaneously, however, the pressure of application, and to some extent the length of the applied wedge was also changed. If, for example due to operating reasons, the application pressure had to be changed without changing the angle of application, it was necessary to exchange the doctor blade or squeegee, by using a stiffer, or softer squeegee, requiring interchange, disassembly and re-assembly of the element itself.

A squeegee roller has been proposed in which the application pressure could be controlled by changing a magnetic force; the angle between the contact point of the roller and the stencil could be changed by changing the roller itself to one of different diameter. This system has the disadvantage that a plurality of rollers had to be carried in stock and, further, the force or pressure of application could be changed only within a limited range.

It has previously been proposed to secure or attach a squeegee or doctor blade arrangement in which the point of application of the blade could be changed without changing the application pressure by so mounting the blade that the axis of the stencil is approximately coincident with the swing or rocking axis of the blade. In this arrangement, however, the contact line between the blade and the stencil changes with respect to the contact line of the stencil and the printing blanket on which the printing goods are transported. This may deform the printing stencil.

It is an object of the present invention to provide an ink application arrangement which permits, by simple means and structures, to change the angle of application of the ink application device with respect to the contact line with the rotary screen within wide ranges without, at the same time, changing the pressure of application and, preferably, changing the relative position of the contact line with respect to an underlying printing blanket or support.

SUBJECT MATTER OF THE PRESENT INVENTION

Briefly, a swing or rocking support is provided for the ink application holding device, i.e., the support for the blade, which can swing about a swing axis located above, and adjacent a line passing through the contact line of the rotary screen and the back-up support, for example the printing blanket and an underlying support element or table. The contact line, as well as the pressure of application will be essentially unchanged even if the angle of application changes over a wide range.

The invention will be described by way of example with reference to the accompanying drawings, wherein.

Figure 1:
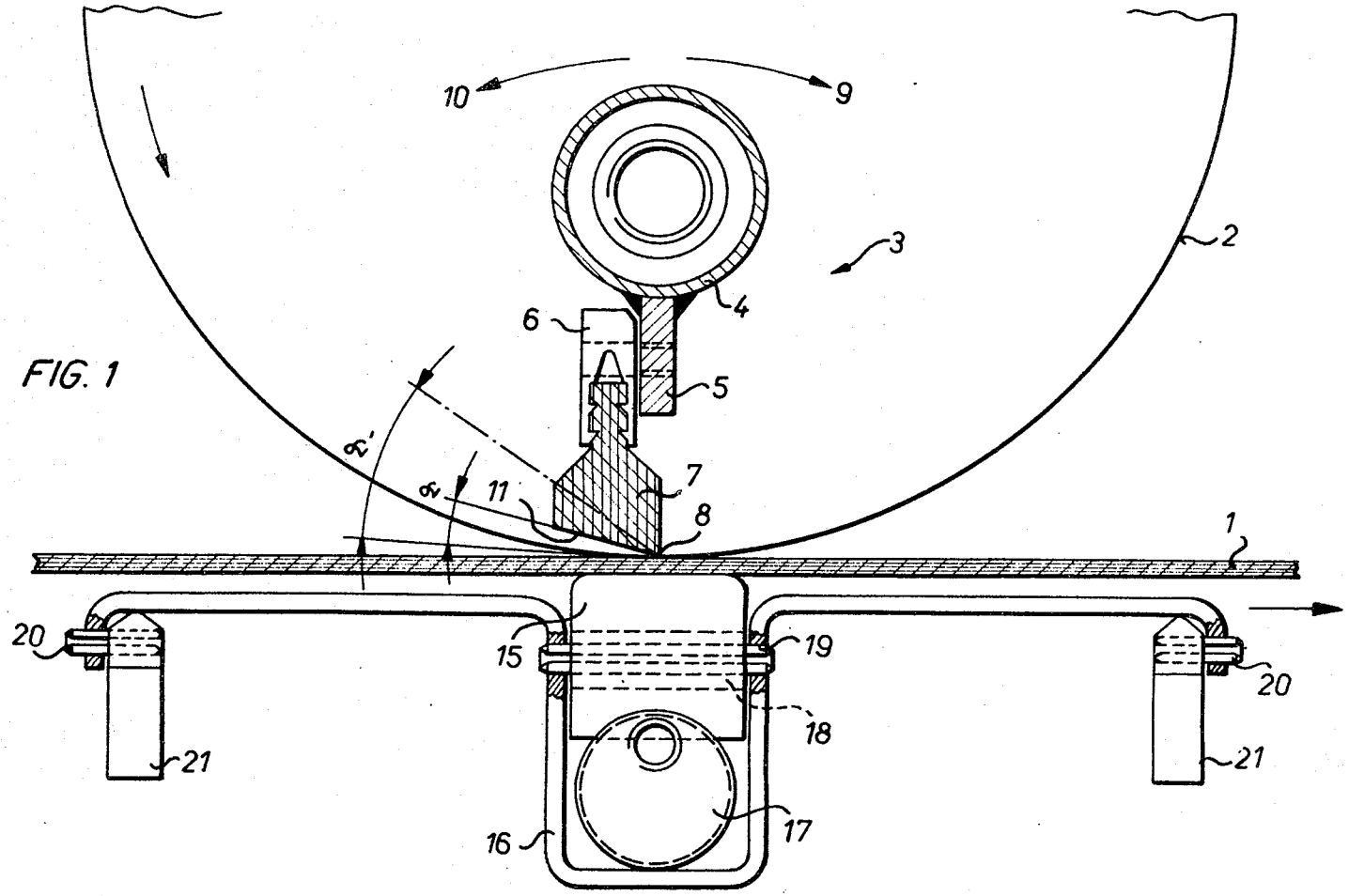
FIG. 1 is a schematic vertical sectional view through a fragment of a rotary screen stencil, the transport blanket, and the back-up support therebeneath.

A moving backing cloth or printer's blanket 1 (FIG. 1), to which the material to be printed is suitably secured, is carried beneath a rotary screen 2, preferably synchronized with rotation of the screen 2, and at a linear speed which matches that of the linear circumferential speed of screen 2. The interior of screen 2 includes a squeegee or doctor blade holder, generally indicated at 3. The blade or squeegee holder 3 includes a holding tube 4, to which a projecting rail 5 is attached, for example by welding. A squeegee or blade retaining channel 6 is secured to rail 5, in any suitable manner, for example by means of bolts, screws or the like. Squeegee or blade channel 6 holds a squeegee or doctor blade element 7 therein. The contact line of the screen 2 with the printing blanket or backing cloth 1 is illustrated at 8. The doctor blade element, or squeegee 7 is in contact with the interior of the screen 2 approximately at line 8. An angle of incidence $\alpha$ arises between the screen 2 and the relieved leading lower surface of blade or squeegee 7. This angle $\alpha$ provides a nip for ink to be pressed through the interstices of the screen 2. It is desirable to change this angle $\alpha$ over a wide range, for example to a value of $\alpha'$ at the upper limit, or less than the value of $\alpha$ as shown. The swing axis of the holder 3 and the contact line 8 should be close to each other, so that the contact line 8 will also form the line of engagement of blade 7 with screen 2. In accordance with the present invention, the contact line 8 of the blade 7 remains essentially unchanged regardless of the angular position of the blade 7. The adjustment of the angle $\alpha$ of the blade 7 is indicated by arrows 9, 10, by swinging or rocking the squeegee system.

The lower surface 11 of the blade 7, which defines the angle $\alpha$ with the tangent of the screen 2, is of substantial size. The angle, however, is essentially defined and determined only by the actual angle which occurs immediately adjacent the contact line 8.

An upwardly adjustable support 15, forming a pressure rail extending transversely of the printer's blanket 1 is located beneath the printer's blanket 1. It defines a plane, and with it an exactly located contact support surface for the printer's blanket 1. The rail 15 is movably located in a support structure including a generally U-shaped support sheet, or frame 16, to be movable in vertical direction. It is pressed from beneath the U-bent sheet 16 upwardly by means of a pressure tube 17, in which pneumatic or hydraulic pressure can be introduced. The rail 15 is supported in axial direction, that is, transverse to the movement of the printer's blanket 1. Slits 18 in the rail 15, in which pins or bolts 19 are guided maintain the rail 15 in position. The pins 19 are journalled in suitable openings in the frame 16. Similar pins 20 are used to secure the holding structure 16 to suitable frame supports 21.

The rotary screen 2 is held at the two axial ends in bearing housings 26, 27 (FIGS. 2–5). The screen 2, as well as the holder 3 are secured in these bearing housings 26, 27. Reference may also be had to the cross-referenced U.S. Pat. Nos. 3,557,690 and 3,599,565, assigned to the assignee of the present invention, in which bearing supports for the rotary screen, as well as for the squeegee or blade are described. Attachment of screen 2 to the bearing rings 28 (FIGS. 3,5) will not be described in detail, reference being made to the aforementioned cross-referenced patents and application. The bearing rings 28 to which the screens, or stencils are attached, are connected by means of screws 29 (FIG. 3) to a flanged ring 30. They are journalled in the bearing housings 26, 27 by means of a roller bearing 31. Housings 26, 27 each include axially arranged housing parts, 35, 36, 35′, 36′, forming half shells, which are held together by screws 37, 37′. The housings 26, 27 are secured to the machine frame by brackets (FIG. 2) and screws 66.

Figure 5:
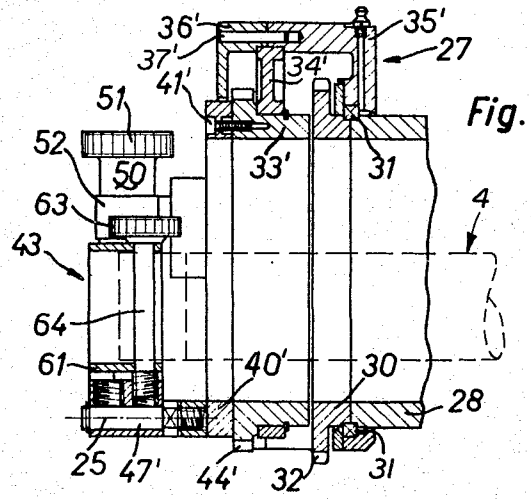
FIG. 5 is a cross-sectional view along line V—V of FIG. 4.

The flanged ring 30 illustrated in FIG. 5 is formed with a projecting gear ring 32 which is in driving connection with a drive gear which rotates the screen stencil 2.

Rings 33, 33′ (FIGS. 3, 5) are rotatably journalled in the housings 26, 27, by means of bearing flanges 34, 34′. Ring 33 has an abutment screw 28 screwed therein which cooperates with a pair of abutments or stops 39 located in bearing flange 34. Rings 33, 33′ are formed with respective gear rings 44, 44′. The squeegee, or doctor blade holding apparatus 42, 43 is attached to the rings 33, 33′, to permit rotation and rocking of the entire squeegee or doctor blade holding apparatus 42, 43 (FIGS. 2, 4) together with the doctor blade support, by means of a gear drive (not shown), engaging gears 44, 44′. This rotation, or rocking is independent of rotation of the screen 2, since the screen bearing rings 28 and rings 33, 33′ are not connected and independently journalled in the housing.

The doctor blade rocking holders 42, 43 have rings 40, 40′, secured to respective rings 33, 33′ and double-armed levers 45, 46 (FIGS. 2, 4) which may rock about respective pins 47, 47′ located, and secured to the ring 40. The fulcrum, or rocking axes are the centers of pins 47, 47′, shown as 25, 25′. Lever 45 has a first arm 48 which is engaged by an adjustemtn spindle 49, which cooperates with a spindle nut 50, which has a knurled manually operated extension head 51. Spindle nut 50 having a knurled head 51 is journalled in a guide sleeve 52 secured to bearing ring 40. Guide sleeve 52 itself may rock about a diametrical axis so that guide sleeve 52 may follow the minor angular changes of the adjustment spindle 49 and of spindle nut 50 upon change of the angle of incidence of the squeegee or doctor blade 7 with respect to screen 2. The first arm 48 is connected to spindle 49 by means of a pin 53. Rings 40, 40′, carrying the respective holding apparatus 42, 43 are secured to the respective rings 33, 33′ by screws 41, 41′.

Figure 2:
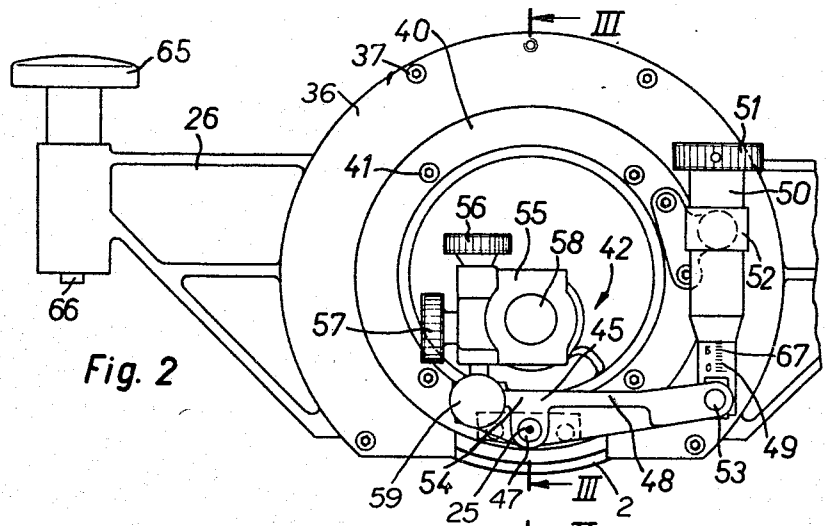
FIG. 2 is a side view of the bearing housing for a printing station with an associated squeegee or ink application holder arrangement.

The second arm 54 of the lever 45 is connected to a support element, or support block 55 (FIG. 2). The distance of the support block 55 with respect to the axis 25 of pin 47 is adjustable by means of a knurled nut 56 connected to a screw spindle. A knurled holding nut 57 locks the blade holder in bore 58 of the support 55, to permit locking it in place similar to a set screw. Support 55 has been omitted from the showing in FIG. 3 for clarity. Screw 59 (FIG. 3) clamps the support block 55 to the arm 54 of the double-arm lever 45.

Figure 4:
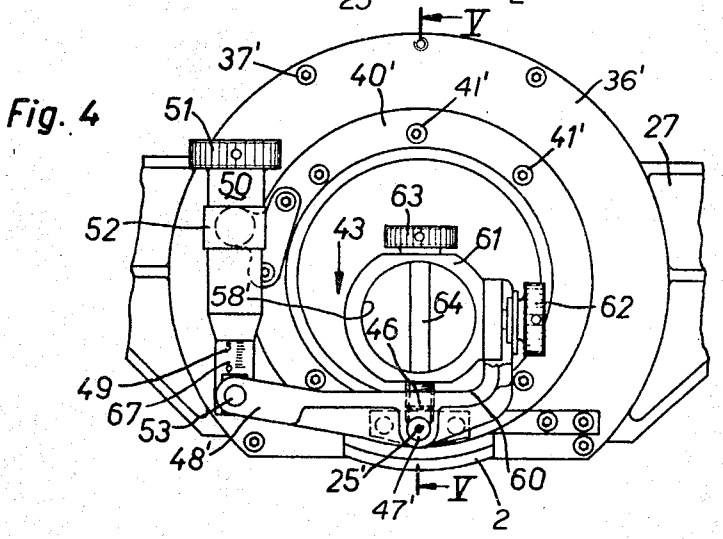
FIG. 4 is a side view of the bearing housing which is opposite that of the bearing of FIG. 2.

The lever 46 (FIG. 4) has a first arm 48′ and a bent-over arm 60 to which a support block, in form of a ring 61 is attached (FIGS. 4, 5). The ring-shaped support block 61 forms a socket for the blade holding tube 4. Block 61 is clamped by means of a knurled clamping screw 62 to the arm 60. An adjustment screw with a knurled head 63 permits height adjustment with respect to the axis 25′ of pin 47′. The shaft 64 of the adjustment screw attached to head 63 additionally serves as a guide element for a slit in the blade holder tube 4, (not shown in FIG. 4) which can fit in bore 58′ of support block, or ring 61.

The screws 66 (FIG. 2) have handles 65 and secure the bearing housings 26, 27 (FIG. 2), height-adjustably, to the frame (not shown) of the screen printing machine.

The swing axes 25, 25′, forming the central axes of pins or shafts 47, 47′ are located above the contact line 8, but still low, so that they practically coincide with the engagement line of the squeegee or blade 7 at the inside of the screen 2 (FIG. 1) although located thereabove. The angle $\alpha$ (FIG. 1) is adjusted by rotating the spindle nuts 50 at the respective sides (FIGS. 2, 4, 5) by means of the manually operated heads 51. A scale 67 (FIGS. 2, 4) permits reading of exact height adjustment, and thus reproducible setting of the angle $\alpha$.

Figure 3:
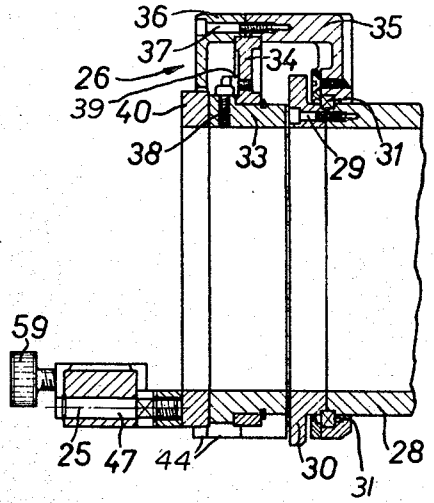
FIG. 3 is a sectional view along line III—III of FIG. 2.

The blade holder 3, essentially, includes the blade holder tube 4, (shown schematically in FIG. 5 in broken lines) which is held in the support blocks 55, 61 (FIGS. 2–4).

The rocking arrangement for the doctor blade is simple. It can easily be attached as a unit to the support rings 40, so that the entire arrangement can be rotated, as explained in detail, for example, in the cross-referenced U.S. Pat. No. 3,557,690. Nevertheless, the angle $\alpha$ can be adjusted precisely and reproducibly.

Briefly, the invention thus comprises a bearing housing 26, 27 secured to the frame of the machine, in which bearings 31 are located journalling the screen stencil 2. The blade support apparatus 42, 43 which supports the holder 4, 6 for the blade 7 is secured to the machine and includes the rotatable support rings 40, 40' which, in turn, are rotatably supported in the bearing housing 26, 27, to permit rotation of the support rings independently of rotation of the screen stencil. The blade holder support means are secured to the independently rotatably rings 40, 40' by means of rocking levers 45, 46 which can rock about the fulcrum pins 47, 47', which have their fulcrum axes 25, 25' located above and closely adjacent to the contact line 8 of the screen stencil 2 and the support 15 therebeneath. Thus, the entire blade support apparatus 42, 43 can swing independently of the screen, for example, to remove the blade from the contact line during down-time of the machine, as explained in cross-referenced U.S. Pat. No. 3,557,590, without, however, disturbing the pressure and angular relationships previously established of the squeegee or doctor blade 7 with respect to the circumference of the screen stencil, and to permit adjustment of the angle of application of the doctor blade within the screen without essentially changing the relative position of the contact line 8 with respect to an underlying printed blanket or support or materially changing the pressure of application.

I claim:

1. A rotary screen printing machine having a frame, a cylindrical rotary screen stencil (2), a backup support (15) located to cooperate with the screen stencil (2) and to define a contact line therewith, a squeegee or doctor blade holder (4, 6) and a squeegee or doctor blade (7) attached thereto and located within the cylindrical screen;

bearing housings (26, 27) secured to the frame adjacent the respective ends of the screen stencil;

bearings (31) journalling the screen (2) located in the bearing housings;

and an adjustable blade support means (42, 43) supporting the blade holder (4, 6) and secured in the bearing housings at the respective ends of the screen for rotation independently of rotation of the screen, at least one of said adjustable blade support means comprising a rotatable support ring (40, 40') rotatably supported on the bearing housing (26, 27) for rotation independently of the screen;

a fulcrum pin (47, 47') having a fulcrum axis (25, 25') located above, and radially inwardly of the stencil (2), and closely adjacent to the contact line (8) of the screen (2) and the support (15);

a rocking lever (45, 46) swingably mounted on said fulcrum pin (47, 47') to rock about said axis (25, 25') and operatively connected to said blade holder (4, 6), said fulcrum pin (47, 47') being secured to the support ring (40, 40') and supporting said rocking lever (45, 46) for rocking movement about the axis (25, 25') of said fulcrum pin (47, 47');

an adjustable spindle (49, 67) secured to the support ring (40) engaging the rocking lever (45, 46) and setting the position of the rocking lever (45, 46) with respect to the respective support ring (40);

a support block (55, 61) supporting said blade holder height-adjustable means (56, 62, 63, 64) securing the blade holder support block (55, 61) to the rocking lever (45, 46) to adjust the distance of the support block (55, 61) and hence of the blade (7) from the contact line (8);

and wherein the rotatable support ring (40, 40') is concentric with the cylindrical rotary screen stencil (2), whereby said fulcrum pin, and said spindle, both secured to said rotatable support ring (40, 40') will be rotatable with respect to the bearing housing (26, 27), and thus rotatable independently of the screen while defining a tilt axis for said blade holder (4, 6) and hence said blade above the contact line and closely adjacent thereto to locate said rotatable support ring, said fulcrum pin, and said rocking lever entirely above said contact line (8) and hence above said back up support (15).

2. Machine according to claim 1, wherein the blade holder support block comprises an apertured socket (61) shaped to receive the blade holder (4, 6), and the height-adjustment means comprises a spindle (64) extending radially inwardly of the support ring (40, 40') to adjustably position the socket (61) and hence the blade above the contact line (8).

3. Machine according to claim 1, wherein the adjustable spindle (49, 67) engaging the rocking lever extends in a direction away from the contact line (8) of the screen (2) and the back up support (15) and setting the position of the rocking lever with respect to the support ring (40, 40');

the blade holder being secured to said rocking lever (45, 46) by said height-adjustable means, and thus moved by said rocking lever (45, 46) to adjust the position of the blade holder (4, 6) by rocking about said axis (25, 25') with respect to said contact line (8) and to locate the adjustable support means upwardly and away from said back-up support (15).

4. Machine according to claim 1 wherein the lever (45, 46) is a double-arm lever (48, 54; 48', 60), one arm (54, 60) being connected to the blade holder (4, 6), and the other arm (48, 48') being engaged by said spindle (49, 67).

* * * * *